United States Patent [19]

Knecht

[11] 4,265,317

[45] May 5, 1981

[54] FIRE RESISTANT MATERIAL

[76] Inventor: Werner Knecht, Usserdorf 6, CH-5312Döttingen, Switzerland

[21] Appl. No.: 29,413

[22] Filed: Apr. 12, 1979

[30] Foreign Application Priority Data

Apr. 25, 1978 [CH] Switzerland ..... 4427/78

[51] Int. Cl.[3] ..... A62C 7/00

[52] U.S. Cl. ..... 169/50; 428/921

[58] Field of Search ..... 169/48, 49, 50; 428/906, 920, 921

[56] References Cited

U.S. PATENT DOCUMENTS

| | | | |
|---|---|---|---|
| 2,183,113 | 12/1939 | Bennett | 169/50 |
| 3,049,389 | 8/1962 | Chappellier | 169/50 |
| 3,782,475 | 1/1974 | Schmidt | 169/50 |
| 3,914,513 | 10/1975 | Brown et al. | 428/921 |
| 4,100,074 | 7/1978 | Abe et al. | 428/921 |

FOREIGN PATENT DOCUMENTS

| | | | |
|---|---|---|---|
| 15685 | of 1903 | United Kingdom | 169/50 |

*Primary Examiner*—Robert J. Spar
*Assistant Examiner*—Kenneth Noland
*Attorney, Agent, or Firm*—Pollock, Vande Sande & Priddy

[57] ABSTRACT

A device for containing and extinguishing fires and for preventing fires comprises a double-layer plastics foil consisting of polyethylene or polyproplene which contains flame-smothering or flame inhibiting additives, the foil being intended in use to be laid upon burning or endangered objects to form an air-excluding protective layer which covers all irregularities in sealed manner due to the pliability of the foil.

The double-layer foil is produced by blowing on an extruder, flame-smothering or inhibiting additives such as granular antimony being added to the foil material. Additives are preferably added which enter into a homogeneous combination with the foil material.

4 Claims, 2 Drawing Figures

FIRE RESISTANT MATERIAL

Figure 1:
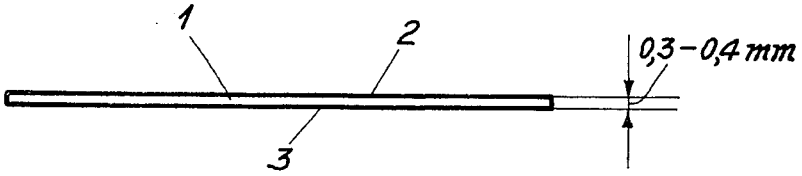

The present invention relates to a device for containing and extinguishing fires and preventing fires, especially extensive fires and fires in dwellings, which differs from known extinguishing means and appliances in that it takes the form of a synthetic plastics foil, such as polyethylene or polypropylene, which contains flame-smothering or inhibiting additives and is intended in use to be laid upon burning or endangered objects to form an airexcluding protective layer which, due to the flexibility of the foil, covers all irregularities in sealed manner.

In addition the invention relates to a method for the production of the device.

Figure 2:
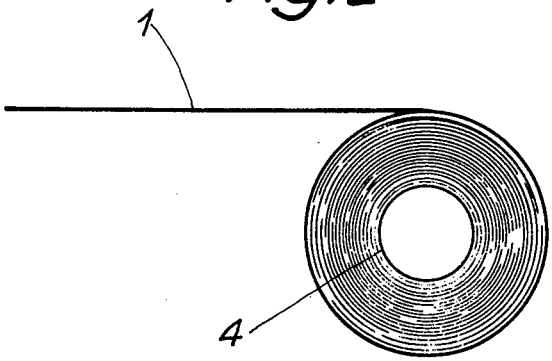

A form of embodiment of the object of the invention is illustrated by way of example in the drawing, wherein:

FIG. 1 is a partial longitudinal section or cross-section through the device, and FIG. 2 shows the device wound on to a roll and withdrawable from the roll for use.

The device for containing and extinguishing fires and for preventing fires consists according to FIG. 1 of a double-layer foil 1 of polyethylene or polypropylene. The thickness of the double-layer foil, blown on an extruder, is 0.3–0.4 mm. A thickness of 0.2–0.6 mm. has also proved expedient. Its melting range lies between 105° C. and 135° C. The raw material for the foil contains flamesmothering or inhibiting additives such as antimony. The raw material of polyethylene and the additives combine during the extrusion operation into a homogeneous, whitish polyehtylene foil.

The foil 1 is formed from an upper layer 2 and a lower layer 3, the two layers being sealed to one another along the longitudinal edges of the foil, as illustrated in FIG. 1, but being otherwise spaced from one another to provide a cavity between the layers which acts additionally as insulation. The foil is inert to water, alkalis, salt solutions, etc. and possesses a low water vapour permeability. It is soft, toughly elastic and flexible and possesses a high electric insulation capacity.

As FIG. 2 shows, the foil is wound on to a roll 4 and is placed on the market in this form in any desired widths, or cut to shape as an extinguisher blanket. A piece required to cover a fire is separated in each case from this roll. Since the foil is produced in any desired width and wound on to rolls 4, for example in the case of widespread conflagrations (fuel, kerosene, field or forest fires), by unrolling webs of any desired length it is possible to extinguish large areas in minimum time. The foil webs can be unrolled like a carpet. Since the foil has a relatively low melting point, as a result of the heat radiated by the fire it places itself in plastic manner immediately airtightly over all irregularities and smothers the flames. In order to prevent all danger of fire, for example at airports as a result of escaping fuel, such as petrol or kerosene, the foil is drawn over the escaping liquid . In the case of forest fires the foil is laid in clear aisles so that the fire is prevented from jumping over.

The production of the double-layer web from polyethylene foil is effected by blowing on an extruder, the flame-smothering or inhibiting additives being added. The additives are of such nature that they enter into a homogeneous combination with polyethylene. In the blowing of polyethylene, antimony in granular form is added thereto by the extruder.

I claim:

1. A device for extinguishing fires comprising a thin, pliable, air-impervious sheet having a thickness in the range of substantially 0.2 to 0.6 mm and a melting point in the range of substantially 105° C. to 135° C., said sheet being fabricated of a synthetic plastic material containing a flame-smothering and flame-inhibiting additive which is homogeneously distributed within and throughout the said plastic material, said sheet being adapted to be laid upon a burning object and, by reason of the pliability, weight, and melting point of the said thin sheet, being adapted to be partially melted by the heat radiated by said object and to plastically conform to irregularities in the burning object thereby to form an air-excluding fire extinguishing layer which completely covers and seals the burning object, wherein said sheet consists of two superposed layers of said plastic material and additive, said two layers being separated from one another by an intervening thin layer of air acting as an insulator.

2. The device of claim 1 wherein the composite thickness of said layers of plastic material and air is in the range of substantially 0.3 to 0.4 mm.

3. The device of claims 1, or 2 wherein said synthetic plastic material is polyethylene, and said additive comprises antimony in granular form.

4. The device of claims 1, or 2 wherein said sheet is in elongated strip form wound into a roll from which selected lengths of said sheet may be unrolled when desired.

* * * * *